US006883426B2

(12) United States Patent
Hachmann et al.

(10) Patent No.: US 6,883,426 B2
(45) Date of Patent: Apr. 26, 2005

(54) PRINTING MACHINE AND METHOD FOR PRINTING A SHEET

(75) Inventors: Peter Hachmann, Dossenheim (DE); Andreas Henn, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 378 days.

(21) Appl. No.: 10/026,240

(22) Filed: Dec. 21, 2001

(65) Prior Publication Data

US 2002/0124747 A1 Sep. 12, 2002

(51) Int. Cl.[7] ..... B41F 5/02

(52) U.S. Cl. ..... 101/230; 101/231; 101/409; 271/195; 271/276; 271/277

(58) Field of Search ..... 101/229, 230, 101/231, 485, 474, 483, 183, 409; 271/195, 196, 276, 277

(56) References Cited

U.S. PATENT DOCUMENTS 4,165,689 A * 8/1979 Giuiuzza ..... 101/230
4,188,883 A * 2/1980 Schöne et al. ..... 101/183
4,856,426 A * 8/1989 Wirz ..... 101/230
4,930,414 A * 6/1990 Wirz ..... 101/183
5,134,938 A * 8/1992 Büsse et al. ..... 101/230
5,598,779 A * 2/1997 Haas et al. ..... 101/230
5,609,103 A * 3/1997 Stephan et al. ..... 101/230
5,687,964 A * 11/1997 Stephan et al. ..... 271/195
5,701,819 A * 12/1997 Stephan ..... 101/409
6,044,760 A * 4/2000 Krüger ..... 101/232
6,089,155 A * 7/2000 Kemmerer ..... 101/183
6,089,156 A * 7/2000 Stephan ..... 101/230

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A printing press for one-sided or two-sided printing of a sheet includes a transfer cylinder disposed in a travel direction of the sheet between a first and a second impression cylinder, respectively, of two printing units, and a sheet support assigned to the transfer cylinder for receiving the sheet thereon before the sheet is transferred to the second impression cylinder, an inverting drum disposed in the travel direction of the sheet between the sheet support and the second impression cylinder, the inverting drum serving for picking up the sheet from the sheet support and transporting the sheet to the second impression cylinder; and a method of operation.

12 Claims, 6 Drawing Sheets

PRINTING MACHINE AND METHOD FOR PRINTING A SHEET

BACKGROUND OF THE INVENTION

FIELD OF THE INVENTION

The invention relates to a printing press for one-sided or two-sided printing of a sheet, and a method for printing a sheet in the printing press.

Rotary printing presses are used for producing one-sided multicolor printing or two-sided multicolor printing. In two-sided multicolor printing, it is necessary for the sheet to be printed on both the front and rear sides thereof. For that purpose, the sheet in the printing press is inverted by a transfer cylinder between two impression cylinders. For flexible use of a rotary printing press, it is desirable to convert the printing operation from one-sided to two-sided printing, so that, depending upon the set printing operation, the sheet takes different travel paths.

From the published German Patent Document DE 39 03 093 A1, a sheet inverter has become known heretofore, wherein, in a one-sided multicolor printing operation, the sheet is transferred between a first impression cylinder and a second impression cylinder via the transfer cylinder. In this regard, the side of the sheet to be printed is guided in like manner on both the first and the second impression cylinder. If the rear side of the sheet is then to be printed additionally, the sheet is transferred from the transfer cylinder to a storage drum. The storage drum transfers the sheet by the trailing edge thereof to an inverting drum which, in turn, transfers the sheet, with the trailing edge thereof leading, to the second impression cylinder. In this case, the side of the sheet to be printed has been changed, so that the side of the sheet that has not yet been printed is now printed by the second impression cylinder.

The disposition of a storage drum is relatively complicated and requires a considerable amount of installation space in the printing press.

From the published German Patent Document DE 37 17 093 A1, a rotary printing press for one or more-sided printing of sheets has become known heretofore wherein a transfer cylinder is disposed between a first and a second impression cylinder. The transfer cylinder has a sheet support assigned thereto, whereon a sheet, arriving from the first impression cylinder, is placed with the leading edge of the sheet leading; the trailing edge of the sheet is firmly held by the transfer cylinder and is transferred to a gripper of the second impression cylinder. The sheet support thus serves for briefly storing the sheet, by which a simple inversion of the sheet is possible.

SUMMARY OF THE INVENTION

It is an object of the invention is to provide a more-flexible printing press for inverting a sheet.

With the foregoing and other objects in view, there is provided, in accordance with one aspect of the invention, a printing press for one-sided or two-sided printing of a sheet includes a transfer cylinder disposed in a travel direction of the sheet between a first and a second impression cylinder, respectively, of two printing units, and a sheet support assigned to the transfer cylinder for receiving the sheet thereon before the sheet is transferred to the second impression cylinder, an inverting drum disposed in the travel direction of the sheet between the sheet support and the second impression cylinder, the inverting drum serving for picking up the sheet from the sheet support and transporting the sheet to the second impression cylinder.

In accordance with another feature of the invention, the sheet support has a movable slide provided with a gripper for firmly holding one edge of the sheet, the slide being movably retained between the transfer cylinder and the inverting drum.

In accordance with a further feature of the invention, the transfer cylinder has a gripper for transferring the sheet in-register from the transfer cylinder to the gripper of the slide.

In accordance with an added feature of the invention, the sheet support has a suction device formed with a suction opening, the suction opening being disposed in a region of an upper side of the sheet support.

In accordance with an additional feature of the invention, the slide has a toothed rack via which the slide is drivable.

In accordance with yet another feature of the invention, the printing press includes a registration device assigned to the sheet support, the registration device having a stop for braking the moving sheet and moving the sheet, in-register, for transferring the sheet to the gripper of the inverting drum.

In accordance with yet a further feature of the invention, the slide has an upper and a lower toothed rack, and is drivable in an upper path via the lower toothed rack and in a lower path via the upper toothed rack.

In accordance with yet an added feature of the invention, the printing press includes at least one drivewheel for formlockingly engaging in the toothed rack and moving the slide.

In accordance with yet an additional feature of the invention, the printing press includes a gear train, and wherein the drivewheel is connected via a coupling to the said gear train.

In accordance with still another feature of the invention, the printing press includes two overturning wheels, and further includes a guide element via which one end of the slide is guidable in a first guide path, and, via one of the overturning wheels, the other end of the slide is movable, symmetrically to the first guide path, into a second path of motion.

In accordance with another aspect of the invention, there is provided a method for two-sided printing of a sheet in a printing press having a transfer cylinder which is disposed in a travel direction of the sheet between a first and a second impression cylinder, respectively, of two printing units, and having a sheet support disposed in the travel direction between the transfer cylinder and the second impression cylinder, the sheet being placed on the sheet support before the sheet is transferred to the second impression cylinder, includes assigning an inverting drum to the sheet support; moving the sheet on the sheet support from a conveyor system to the inverting drum; and having the inverting drum pick up the sheet and guide the sheet to the second impression cylinder.

In accordance with another mode of the method of the invention, transferring the sheet, in-register, from the transfer cylinder to the conveyor system; and transferring the sheet, in-register, from the conveyor system to the inverting drum.

An advantage of the invention is that a sheet support and an inverting drum are disposed between the transfer cylinder and the second impression cylinder. This arrangement offers the advantage that the function of inverting the sheet is transferred from the transfer cylinder to the inverting drum, and a simple device for transferring the sheet from the transfer cylinder to the inverting drum is furnished by the sheet support.

The sheet support preferably has a movable slide, with a gripper that engages an edge of the sheet, and the sheet is moved by a motion of the slide to the inverting drum, which in turn grasps the sheet at one edge. Using a movable slide makes precise transporting of the sheet from the transfer cylinder to the inverting drum possible.

The sheet is preferably transferred from the transfer cylinder to the slide while maintaining registration; that is, the sheet is in a prescribed position relative to the slide. Thus, in-register transfer of the sheet to the inverting drum and to the second impression cylinder is possible, and as a result the sheet is located at a predetermined position relative to the printing operation that is performed at the second impression cylinder. The sheet support preferably has a suction device, with which the sheet can be firmly sucked or aspirated at the sheet support. By the firm suction of the sheet, a defined position of the sheet is prescribed, and the sheet can, for example, be tautened.

In a special embodiment of the invention, a suction opening of the suction device is disposed below the transfer cylinder and provided in fixed position. This affords a simple, economical disposition of the suction device.

In a further feature of the invention, a registration device is provided at the sheet support, and with the registration device, the location of the sheet is detected from a registration character on the sheet, and the sheet is transferred to the inverting drum in a prescribed position.

In this way, in-register transfer of the sheet is possible even if the sheet is not transferred in-register from the transfer cylinder to the sheet support. Thus, in this embodiment as well, precise printing of the rear side of the sheet with the second impression cylinder is possible.

Other features which are considered as characteristic for the invention are set forth in the appended claims.

Although the invention is illustrated and described herein as embodied in a printing machine and method for printing a sheet it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
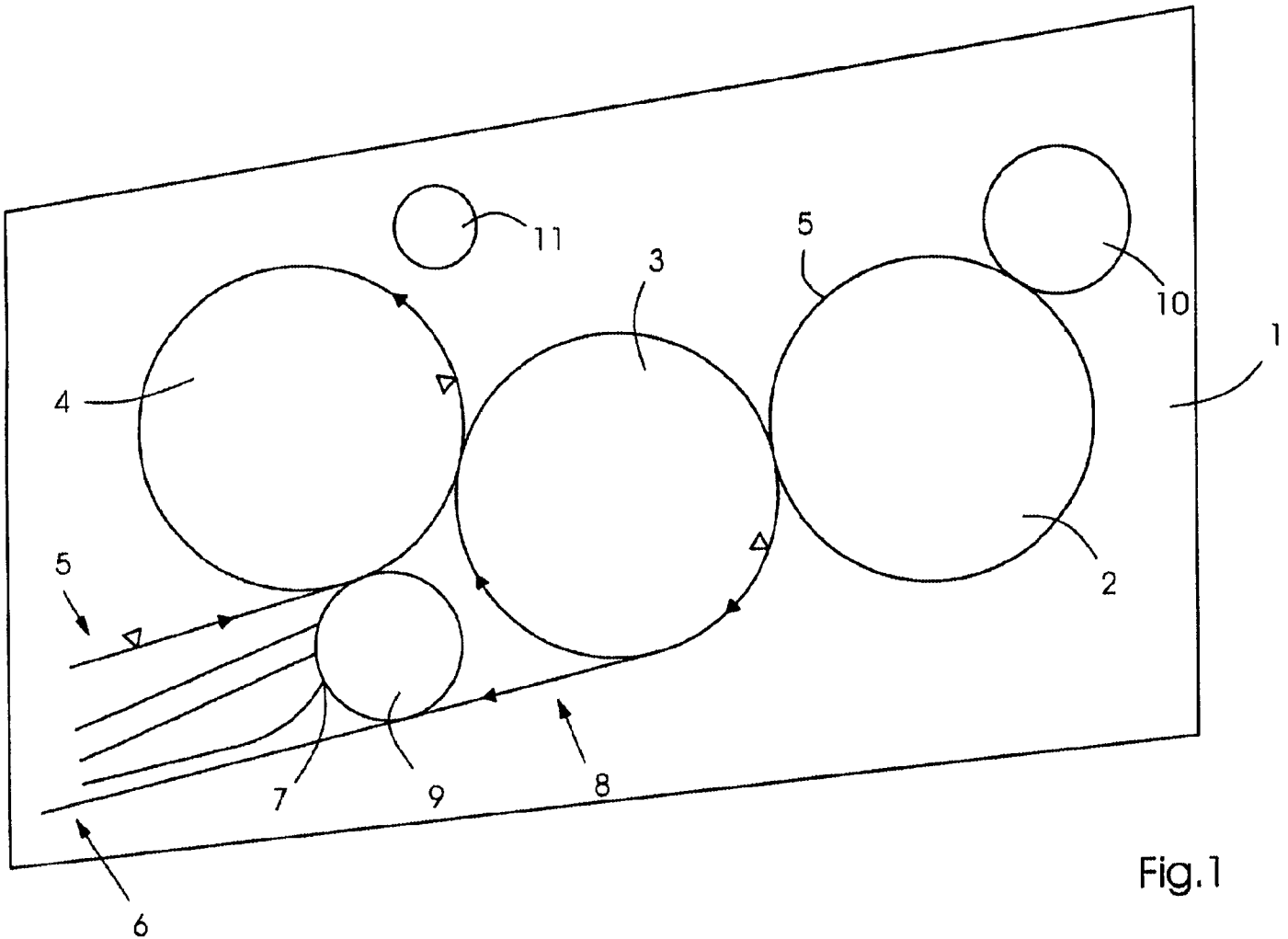
FIG. 1 is a fragmentary diagrammatic side elevational view of a printing press provided with a sheet support located between a transfer cylinder and an inverting drum.

Referring now to the drawings and, first, particularly to FIG. 1 thereof, there is shown therein diagrammatically a detail of a printing press 1 with a first rubber blanket cylinder 10 of a first printing unit of the printing press 1. The first rubber blanket cylinder 10 is assigned to a first impression cylinder 2. To the first impression cylinder 2, in turn, a transfer cylinder 3 is assigned, and to the transfer cylinder 3, a sheet support 8 and a second impression cylinder 4 are assigned. An inverting drum 9 is disposed between the sheet support 8 and the second impression cylinder 4. A second rubber blanket cylinder 11 of a second printing unit is assigned to the second impression cylinder 4. The first impression cylinder 2, the transfer cylinder 3, the inverting drum 9 and the second impression cylinder 4, respectively, are equipped with gripper devices for grasping and firmly holding a sheet 5 by a leading edge and/or a trailing edge 6, 7 thereof, respectively. The first and second rubber blanket cylinders 10, 11, the first impression cylinder 2, the transfer cylinder 3, the inverting drum 9, and the second impression cylinder 4, respectively, are rotatably supported via a pivot shaft in the printing press 1 and are driven at different rotary speeds by a motor.

The arrangement in FIG. 1 functions as follows: A sheet 5 is guided by a leading edge 6 thereof to the first impression cylinder 2 via a non-illustrated feed cylinder. With the gripper device, the first impression cylinder 2 grips the leading edge of the sheet 5 that is being printed and moves the respective sheet 5 past the first rubber blanket cylinder 10. The first rubber blanket cylinder 10 transfers a printing image, which is prescribed by the first printing unit, to the upwardly facing first side of the sheet. The sheet, now printed on the first side thereof, is moved onwardly by the first impression cylinder 2 and transferred to the transfer cylinder 3. If single-sided multicolor printing of the sheet 5 is set as the operating mode, the sheet 5 is then transferred directly to the second impression cylinder 4. The second impression cylinder 4 grasps the sheet and moves the sheet with the first side thereof past the second rubber blanket cylinder 11. The second rubber blanket cylinder 11 transfers a printed image, prescribed by the second printing unit, to the first side of the sheet 5. The first and second printing units transfer a printed image in different colors, so that the sheet 5, after being printed by the second rubber blanket cylinder 11, has a two-colored printed image on the first side.

In a second operating mode, the printing press 1 is set for two-sided printing of the sheet 5, wherein the sheet 5 is placed on the sheet support 8 by the transfer cylinder 3 with the leading edge 6 thereof leading and is moved past and underneath the inverting drum 9. The inverting drum 9 grasps the trailing edge 7 of the sheet 5 and carries the sheet 5, with the trailing edge 7 leading, to the second impression cylinder 4. The second impression cylinder 4 takes over the sheet 5, which now rests with the second side thereof facing upwardly on the second impression cylinder 4. The second impression cylinder 4 moves the sheet 5, by the second side thereof, upwardly past the second rubber blanket cylinder 11. The second rubber blanket cylinder 11 prints the second side of the sheet 5 with a prescribed printed image. Thus, downline from the second rubber blanket cylinder 11, as viewed in the travel direction of the sheets, the sheet 5 has been printed on both the first and second sides thereof. The sheet 5 is then sent onward from the second cylinder 4 to a further cylinder and is further processed by the printing press 1.

An advantage of the invention is that, depending upon the operating mode which is set, a sheet 5 is printed on one or both sides thereof and, in the process, is either transferred directly from the transfer cylinder 3 to the second impression cylinder 4 or is placed on the sheet support 8 and inverted by the inverting drum 9 and transferred to the second impression cylinder 4. The sheet support 8 is provided with at least approximately the form of a planar or slightly curved surface, whereon the sheet 5 rests and is transported onward to the inverting drum 9.

Figure 2:
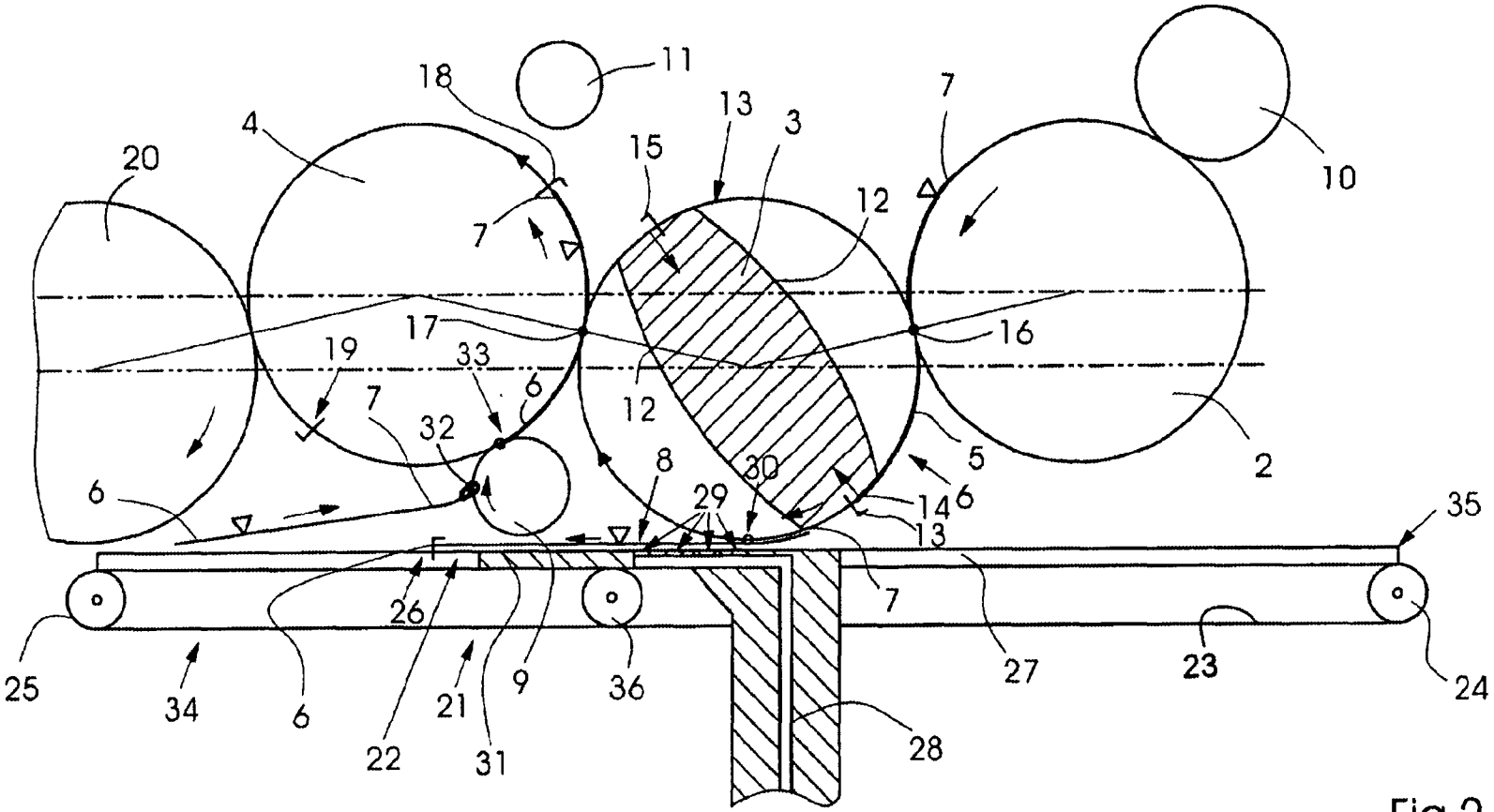
FIG. 2 is a view like that of FIG. 1 of the printing press with a more detailed first embodiment of the sheet support having a movable slide.
Figure 3:
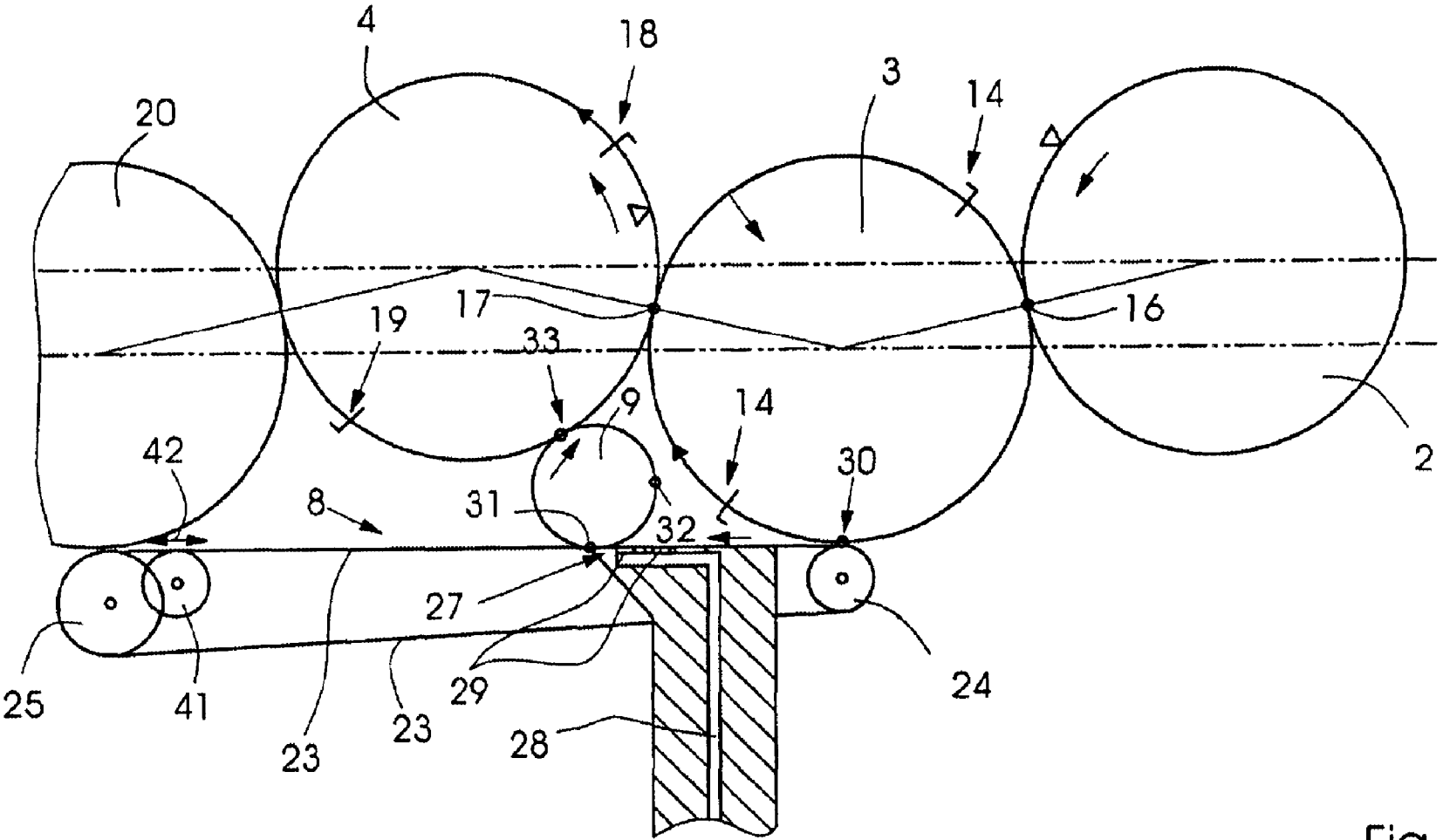
FIG. 3 is a view like that of FIG. 2, but showing a further embodiment of a conveyor system with a suction belt and a registration device.

Further details of the invention are shown in FIGS. 2 and 3. FIG. 2 shows a transfer cylinder 3 in the form of a recessed cylinder having a circumferential wall 12 embodied in the form of two slightly curved surfaces disposed symmetrically to the pivot axis of the transfer cylinder 3. First and second grippers 14, 15 are disposed on respective opposed end regions 13. With the first and second grippers 14, 15, a leading edge 6 of a sheet 5 is gripped and transferred from the first impression cylinder 2 at a first tangent point 16.

The second impression cylinder 4 is associated with the transfer cylinder 3 at a second tangent point 17. The second impression cylinder 4 has a third and fourth gripper 18, 19, with which an edge of the sheet 5 can be grasped and firmly held. For example, in the operating mode of one-sided printing of the sheet 5, the sheet 5 is transferred by the leading edge thereof at the second tangent point 17 from the transfer cylinder 3 directly to the second impression cylinder 4.

The sheet support 8 is disposed below the transfer cylinder 3 and has a conveyor system 21. The conveyor system 21 includes a slide 22 and a belt 23 which, in the form of an endless belt, revolves between the first and second shafts 24 and 25. The slide 22 is solidly connected to the belt 23. A fifth gripper 26 is disposed on the slide 22 and is movable via cam drives or other mechanical or electrical control devices for grasping and firmly holding the leading edge of a sheet 5.

A support table 27 is disposed below the transfer cylinder 3 and has a suction channel 28 extending to suction openings 29 formed on the upper side of the support table 27. The suction channel 28 is connected to a negative-pressure or suction pump, which generates a negative pressure in the suction channel 28 so that, via the suction openings 29, a sheet 5 can be sucked down onto the support table 27. The support table 27 is fixed in position whereas, conversely, the slide 22 is moved by the belt 23 from the first shaft 24 in a direction towards the second shaft 25. In the course of this movement, the slide 22 is moved through a guide recess formed in the support table 27.

The movement of the slide 22 and the rotation of the transfer cylinder 3, when setting the operating mode of inverting the sheet, are synchronized so that the fifth gripper 26 of the slide 22 and the first or second gripper 14, 15 meet at a third tangent point 30. In this meeting, the first or second gripper 14, 15 transfers the leading edge 6 of the sheet 5 to the fifth gripper 26, which firmly clamps the sheet 5 by the leading edge 6 thereof to the slide 22, and the slide 22 moves the sheet 5 onward in the direction towards the inverting drum 9 which is disposed below the second impression cylinder 4. At the same time, the sheet 5 is sucked down onto the support table 27 by the suction openings 29 and, as a result, is placed on the support table 27 and the slide 22. In addition, tension in the direction of motion of the sheet 5 is attained due to the sucking of the sheet 5.

During the transfer of the leading edge 6 of the sheet 5 at the third tangent point 30 from the transfer cylinder 3 to the slide 22, the leading edge 6 of the sheet 5 is transferred In-register, so that the location of the sheet 5 is precisely defined. In this way, it is possible for the sheet 5 to be transferred in-register from the inverting drum 9 to the second impression cylinder 4. The sheet 5 should thereby lie completely flat.

The path of motion of the slide 22 is defined in such a way that the slide 22 moves the sheet 5 past the inverting drum 9 at a fourth tangent point 31. The inverting drum 9 has a sixth gripper 32 by which an edge of the sheet can be grasped and firmly held. The rotation of the inverting drum 9 is synchronized with the motion of the slide 22 so that the sixth gripper 32 is located at the fourth tangent point 31 when the trailing edge of a sheet 5 is moved past the fourth tangent point 31 by the slide 22. In this regard, the sixth gripper 32 grasps the trailing edge 7 and carries the sheet 5, with the trailing edge 7 leading, to a fifth tangent point 33, which the inverting drum 9 occupies together with the second impression cylinder 4. The fifth gripper 26 releases the leading edge 6 of the sheet 5 the instant the sixth gripper 32 has grasped the trailing edge 7.

At the fifth tangent point 33, the trailing edge 7 is transferred to the third or fourth gripper 18, 19. Next, the sheet 5, with the second side thereof facing upwardly, is moved past the second rubber blanket cylinder 11 and printed on the second side.

After the transfer of the sheet 5 to the inverting drum 9, the slide 22 is moved back from the second shaft 25 to the first shaft 24 over a second plane of motion or travel plane 34. At the first shaft 24, the slide 22 is moved back into the first plane of motion or travel plane 35 and, as described hereinbefore, along the first plane of motion 35, is moved past the third and fourth tangent point 30, 31.

For driving the belt 3, a drive shaft 36 is provided, which is driven by a motor. The slide 22 is preferably connected formlockingly to a chain or toothed rack driven by the motor via a gearwheel. In this regard, it is noted that a formlocking connection is one that connects two elements together due to the shape of the elements themselves, as opposed to a forcelocking connection, which locks the elements together by force external to the elements. The gearwheel is coupled via a coupling, in-register, to a drive train of the printing press, so that, upon acceptance and transfer of the sheet 5, the slide 22 is guided in-register.

In this way, inverting in-register transfer of the sheet 5 at the third tangent point 30 is possible. Furthermore, a precise transfer of the sheet 5 to the sixth gripper 32 of the inverting drum 9 is thereby possible, so that a predetermined location with respect to the printing operation can be maintained by the second rubber blanket cylinder 11.

The first plane of motion 35 is preferably embodied as a straight or slightly curved plane, because it is thereby possible to provide the printing press 1 with a smallest possible structural shape.

FIG. 3 shows a further embodiment of the invention, wherein a sheet support 8 is provided with a belt 23, which revolves in the form of an endless belt between the first and second shafts 24, 25. In addition, a delivery table 27 with a suction device that has a suction channel 28 and suction openings 29 is provided, but contrary to the embodiment of FIG. 2, it is disposed between the third and fourth tangent points 30 and 31. In this embodiment, no slide 22 is provided; instead, the sheet 5 is taken over at the third tangent point 30 by the belt 23, which is preferably formed with suction openings as retaining elements. In this regard, the sheet is then not taken over in-register by the transfer cylinder 3. Thereafter, the sheet 5 is moved under the fourth tangent point 31, with the leading edge 6 leading, and is carried by the leading edge 6 to a registration device 41. The registration device 41 is disposed in the first plane of motion 35 and, for example, has a stop element 42, which rotates and establishes a defined location of the sheet 5. The sheet 5 is moved with greater speed than the rotary speed of the stop element by the slide 22 and is braked by the stop element 42 and moved in a defined path of motion, which is embodied in-register with the inverting drum 9. To that end, the registration device 41 is coupled via a coupling into the wheel train of the printing press. Via the coupling, a calibration of the registration device 41 for in-register synchronization is possible. The sixth gripper 32 engages the trailing edge 7 of the sheet 5 at which the sheet 5 is transferred to the third or fourth gripper 18, 19 of the second impression cylinder 4. By using the registration device 41, assurance is provided that the sheet 5 will be transferred to the second impression cylinder 4 in a predetermined printing position.

Figure 4:
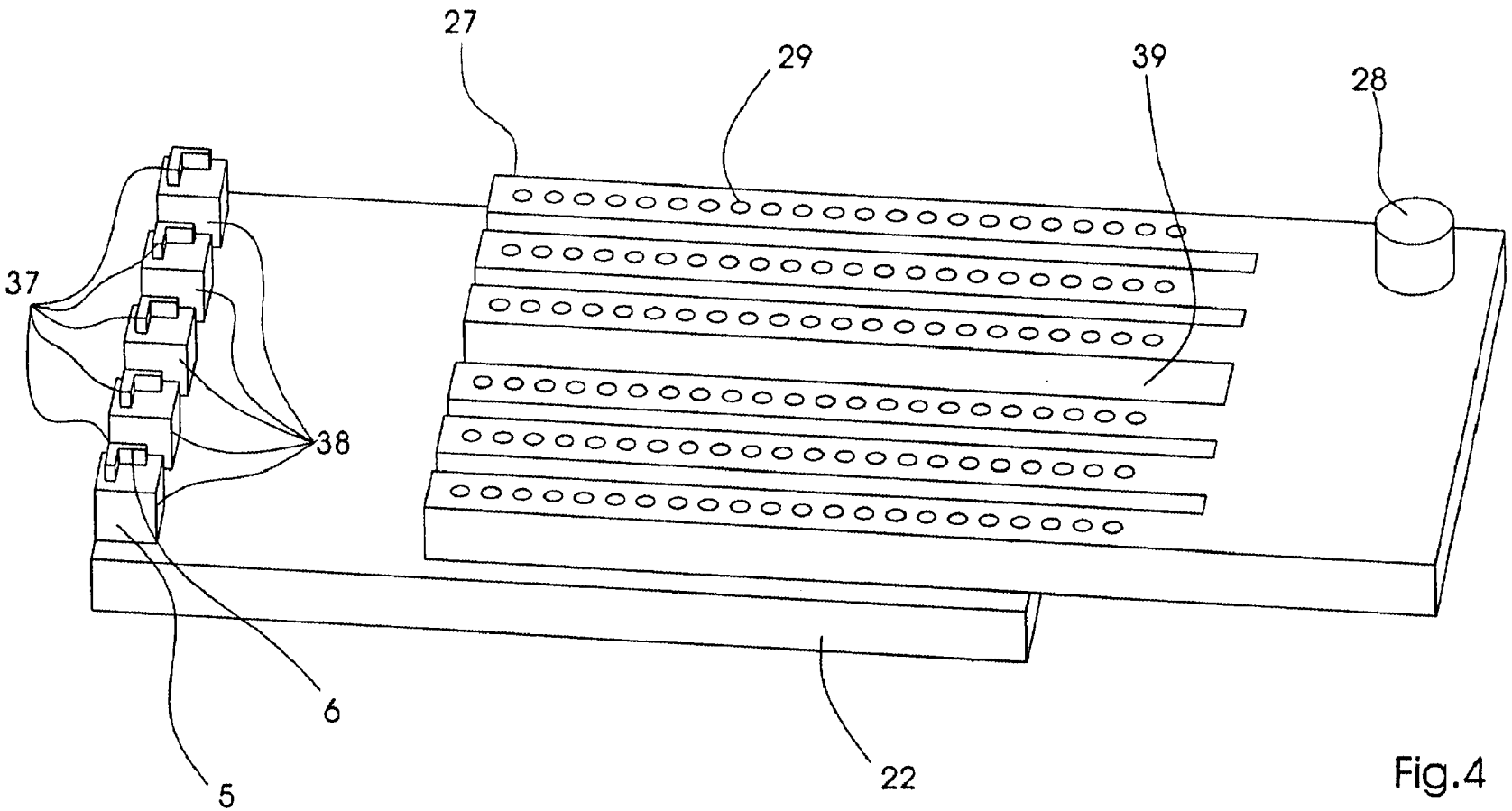
FIG. 4 is a top, side and rear perspective view of the slide with a support table.

FIG. 4 diagrammatically shows the layout of a slide 22 and a support table 27. The support table 27 is formed with guide slits 39, so that the support table 27 has a comblike structure. In the teeth of the comblike structure, suction openings 29 are formed, which are supplied with negative pressure or suction via the suction channel 28. The slide 22 is embodied as an at least approximately rectangular plate, on one transverse side of which a plurality of sheet supports 38 are disposed in parallel adjacent one another, and sixth grippers 37 are associated therewith. When taking over a sheet 5, the edge of the sheet 5 to be taken over is placed on the sheet support 38 and firmly clamped on the sheet support 38 by the seventh grippers 37. The path of motion of the slide 22 is such that the slide 22 is moved to the support table 27 from below, and the sheet supports 38 are guided by the guide slits 39. Next, the sheet is firmly clamped by the seventh grippers 37, and the slide 22 is moved to the lefthand side, away from the support table 27, in the direction towards the guide slits 39. The clamping function of the seventh grippers 37 is performed via cam drives or other mechanical or electrical control devices, which are otherwise not explicitly shown.

Figure 5:
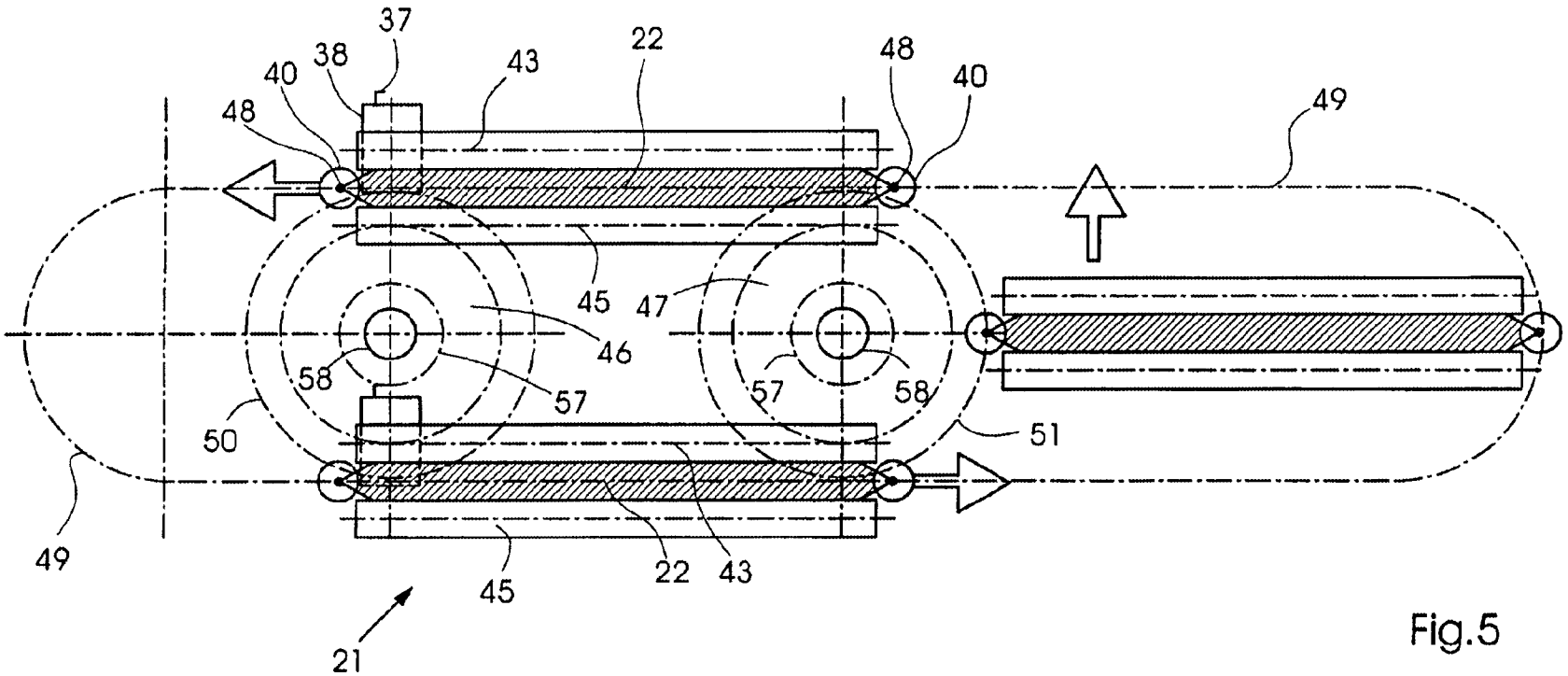
FIG. 5 is a diagrammatic side elevational view of a slide with a toothed rack guide.

FIG. 5 shows a conveyor system 21 wherein a slide 22 is provided, which is guided in-register via toothed racks 43 and 45. The slide 22 has one upper and one lower toothed rack 43 and 45, respectively, which are solidly connected to the slide 22. The sheet supports 38 and the seventh grippers 37 are disposed in the front or leading region of the slide 22. Also, at both ends, the slide 22 has a respective overturning peg or pin 48. The slide 22 is driven in an upper position I by a first and second drive wheel 46 and 47, which form-lockingly or positively engage in the lower toothed rack 45. The first and second drive wheels 46 and 47 are connected to the gearwheel train 58 of the printing press via couplings 57. By a correspondingly synchronized engagement of the first and second drive wheels 46 and 47, in-register guidance of the slide 22 is achieved. The slide 22 is moved from the first position I to the lefthand side, wherein the lefthand overturning peg 48, which is secured to the lefthand side of the slide 22, is guided laterally in a guide path 49 and revolves in a curved path. The righthand overturning peg 48 is grasped during this movement by a first overturning wheel 50 and guided downwardly in a curved path to a second position II. The slide 22 preferably remains horizontal, in this regard. In the second position II, the slide 22 is guided from the lefthand to the righthand side, again via the first and second drivewheels 46 and 47, which forcelockingly engage in the upper toothed rack 43. On the righthand side, the slide 22 is moved upwardly again from the second position in the direction towards the support table 27, not shown in FIG. 5. The righthand overturning peg 48 is guided in the guide path 49, and the lefthand overturning peg 48 is grasped by the second overturning wheel 51 and moved upwardly. When the slide 22 reaches the upper, first position I, the slide 22 is moved a slight distance to the lefthand side by the second overturning wheel 51, so that the second drivewheel 47 can engage in the lower toothed rack 45, and the slide 22 moves to the lefthand side in the direction towards the first drivewheel 46.

Preferably a plurality of slides 22 are provided which, at staggered times, are moved in the revolving path that is prescribed by the guide path 49.

Figure 6:
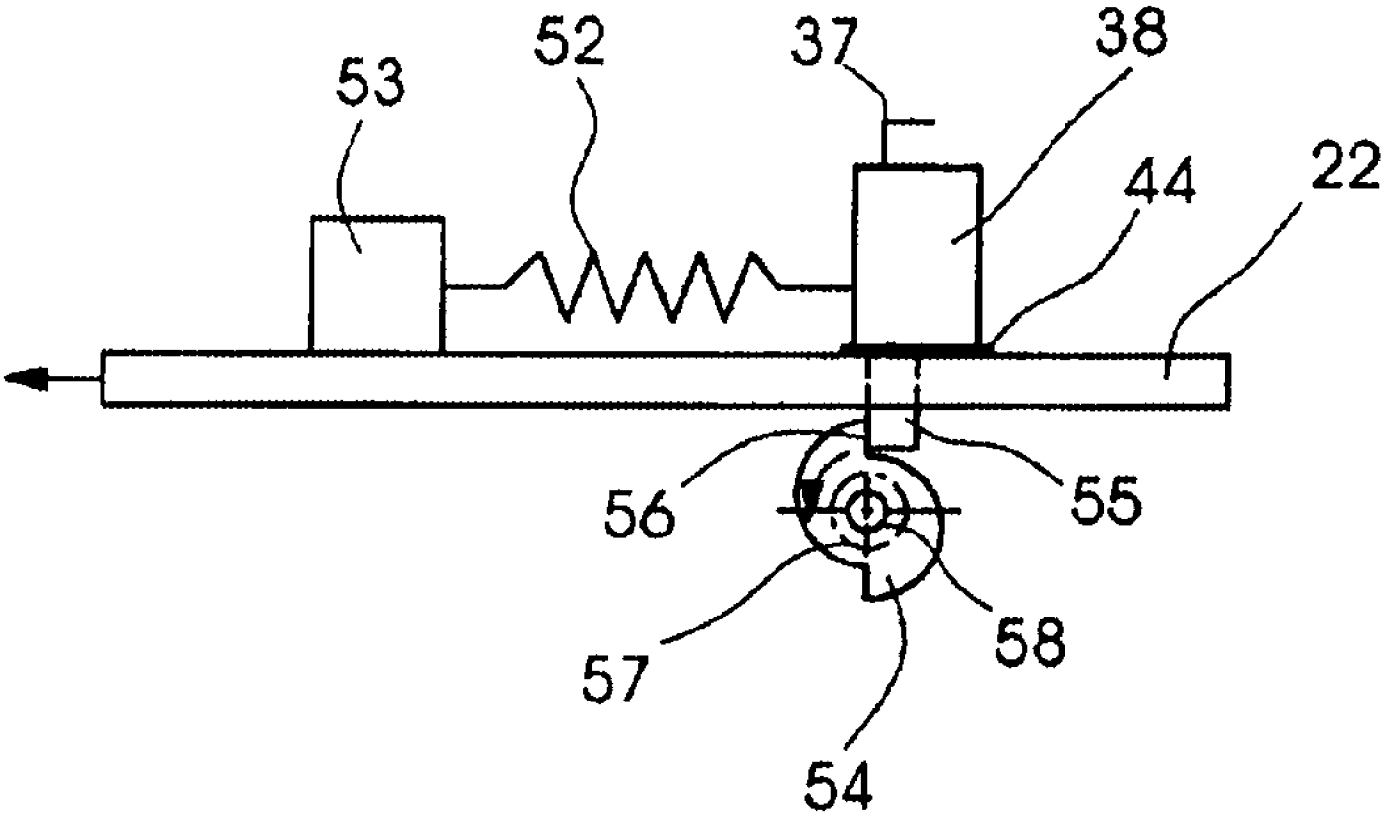
FIG. 6 is a diagrammatic side elevational view of a slide with a registration wheel.

FIG. 6 shows a further embodiment of the invention, wherein the slide 22 is not guided in-register by a belt, chain or other drive, but instead, a registration wheel 54 is provided, which effects an in-register guidance of the slide 22. In the embodiment shown, the slide 22 is moved from the righthand to the lefthand side of FIG. 6 by a belt at a fixed speed, until the slide 22 lies with a calibration lug 55 on a calibration face 56 of the registration wheel 54. The calibration lug 55 is guided through the slide 22 and is secured to a sheet support 38. The slide 22 has an elongated recess, through which the calibration lug 55 is guided downwardly through the slide 22 by the sheet support 38, and which permits motion relative to one another of the sheet support 38 and the slide 22. Via a sliding device 44, the sheet support 38 is connected laterally displaceably with the slide 22. In addition, the sheet support 38 is coupled via a spring element 52 to a fastening block 53 of the slide 22. If the calibration lug 55 engages the calibration face 56 of the registration wheel 54, then the further motion of the sheet support 38 is prescribed by the registration wheel 54. The registration wheel 54 is supported rotatably on a shaft and is coupled via a coupling 57 with the gearwheel train 58 of the printing press. Via the coupling 57, an in-register calibration of the registration wheel 54 takes place, so that the sheet, which is guided by the sheet support 38 and the associated seventh gripper 37, can be received in-register or transferred in-register. In this embodiment, the slide 22 moves faster than the rotary speed of the registration wheel 54, so that, after the contact of the calibration lug 55 with the registration wheel 54, the slide 22 executes a motion relative to the registration wheel 54. However, because of the contact of the calibration lug 55 with the registration wheel 54, the sheet support 38 is coupled directly with the rotary speed of the registration wheel 54, so that the sheet support 38, with the seventh gripper 37 and a sheet 5 clamped therein, executes a relational motion with respect to the slide 22. In this regard, the spacing between the sheet support 38 and the fastening block 53 increases in the in-register guidance by the registration wheel 54. After a prescribed angular rotation of the registration wheel 54 counterclockwise, the calibration lug 55 is released again, and the sheet support 38 is withdrawn into the starting position thereof by the spring element 52.

The embodiment shown in FIG. 6 offers the advantage that the slide 22 need not itself be guided in-register; instead, in-register calibration of the sheet support 38 and of the seventh gripper 37 is effected by a registration wheel 54.

We claim:

1. A printing press for one-sided or two-sided printing of a sheet, comprising:

a transfer cylinder disposed in a travel direction of the sheet between a first and a second impression cylinder, respectively, of two printing units; and a turning device including a sheet support assigned to said transfer cylinder for receiving the sheet thereon before the sheet is transferred to the second impression cylinder, and an inverting drum disposed in a travel direction of the sheet between said sheet support and the second impression cylinder, said inverting drum serving for picking up the sheet from said sheet support and transporting the sheet to the second impression cylinder;

the sheet being transferred from the first impression cylinder to said transfer cylinder and from said transfer cylinder to the second impression cylinder during a one-sided printing operation;

the sheet being transferred from said transfer cylinder to said sheet support and from said sheet support to the second impression cylinder through said inverting drum during a turning operation.

2. The printing press according to claim 1, wherein said sheet support has a movable slide provided with a gripper for firmly holding one edge of the sheet, said slide being movably retained between said transfer cylinder and said inverting drum.

3. The printing press according to claim 2, wherein said transfer cylinder has a gripper for transferring the sheet in-register from said transfer cylinder to said gripper of said slide.

4. The printing press according to claim 1, wherein said sheet support has a suction device formed with a suction opening, said suction opening being disposed in a region of an upper side of said sheet support.

5. The printing press according to claim 2, wherein said slide has a toothed rack via which said slide is drivable.

6. The printing press according to claim 1, including a registration device assigned to said sheet support, said registration device having a stop for braking the moving sheet and moving the sheet, in-register, for transferring the sheet to said gripper of said inverting drum.

7. The printing press according to claim 6, wherein said slide has an upper and a lower toothed rack, and is drivable in an upper path via said lower toothed rack and in a lower path via said upper toothed rack.

8. The printing press according to claim 6, including at least one drivewheel for formlockingly engaging in said toothed rack and moving said slide.

9. The printing press according to claim 8, including a gear train, and wherein said drivewheel is connected via a coupling to said gear train.

10. The printing press according to claim 6, including two overturning wheels, and further including a guide element via which one end of said slide is guidable in a first guide path, and, via one of said overturning wheels, said other end of said slide is movable, symmetrically to said first guide path, into a second path of motion.

11. A method for two-sided printing of a sheet in a printing press having a transfer cylinder which is disposed in a travel direction of the sheet between a first and a second impression cylinder, respectively, of two printing units, and having a sheet support disposed in the travel direction between the transfer cylinder and the second impression cylinder, the sheet being placed on the sheet support before the sheet is transferred to the second impression cylinder, which comprises assigning an inverting drum to the sheet support; moving the sheet on the sheet support from a conveyor system to the inverting drum; and having the inverting drum pick up the sheet and guide the sheet to the second impression cylinder.

12. The method according to claim 11, which includes transferring the sheet, in-register, from the transfer cylinder to the conveyor system; and transferring the sheet, in-register, from the conveyor system to the inverting drum.

* * * * *

UNITED STATES PATENT AND TRADEMARK OFFICE

CERTIFICATE OF CORRECTION

PATENT NO. : 6,883,426 B2
DATED : April 26, 2005
INVENTOR(S) : Peter Hachmann et al.

It is certified that error appears in the above-identified patent and that said Letters Patent is hereby corrected as shown below:

Title page,
Item [30], Foreign Application Priority Data, should read
-- Dec. 21, 2000 (DE) ……. 100 63 742 --

Signed and Sealed this

Ninth Day of August, 2005

JON W. DUDAS
*Director of the United States Patent and Trademark Office*